United States Patent [19]

Cassel

[11] Patent Number: 4,568,944

[45] Date of Patent: Feb. 4, 1986

[54] Y-SHAPED DIPOLE ANTENNA

[75] Inventor: Knut E. Cassel, Järfälla, Sweden

[73] Assignee: U.S. Philips Corporation, New York, N.Y.

[21] Appl. No.: 516,164

[22] Filed: Jul. 20, 1983

[30] Foreign Application Priority Data

Jul. 28, 1982 [SE] Sweden ..... 8204481

[51] Int. Cl.[4] ..... H01Q 9/16

[52] U.S. Cl. ..... 343/802; 343/809

[58] Field of Search ..... 343/739, 740, 802, 809, 343/846

[56] References Cited

U.S. PATENT DOCUMENTS

| | | | |
|---|---|---|---|
| 2,715,184 | 7/1955 | Cork | 343/809 |
| 2,985,877 | 5/1961 | Holloway | 343/809 |
| 3,099,836 | 7/1963 | Carr | 343/809 |
| 3,747,112 | 7/1973 | Hidaka | 343/802 |

*Primary Examiner*—Eli Lieberman

*Attorney, Agent, or Firm*—Robert J. Kraus

[57] ABSTRACT

The invention relates to a directive broad band antenna element of V-shaped dipole type with bent wire- or strip-shaped dipole antenna (A). The dipole antenna is divided into two sections, a first section (S1) where the radiation is minimized (or prevented) by a small distance between the conductors and a reduced phase velocity, and a second section (S2), where the radiation is enhanced by increasing the phase velocity by means of introduced series capacitances (C1, C2, . . . Cn). The series capacitances have respective values which depend on the local angle between the dipole conductors and a radiation axis (x), and are chosen such that the phase velocity is increased to a value which effects radiation contributions from different parts of the conductors to cooperate in the desired radiation direction. Because of the series capacitances, the curvature of the conductors can be made much sharper and the extension of the antenna in the radiation direction will be much smaller for a given frequency band than in the case without series capacitances. This in combination with the reduced (inhibited) radiation from the first section (S1) causes the displacement of the center of radiation (the phase center) with frequency to be limited. Thus the antenna element can operate over a very extended frequency band (on the order of 2 to 3 octaves) and still serve as a primary radiator for illuminating a secondary radiator having a focal point, such as a parabolic reflector or an electromagnetic lens. The reduced phase velocity at the first section (S1) can be achieved by means of a small dielectric disc (D) place between the dipole conductors of the first section and/or zig-zag shaped or inwardly toothed conductors in the first section (S1).

11 Claims, 4 Drawing Figures

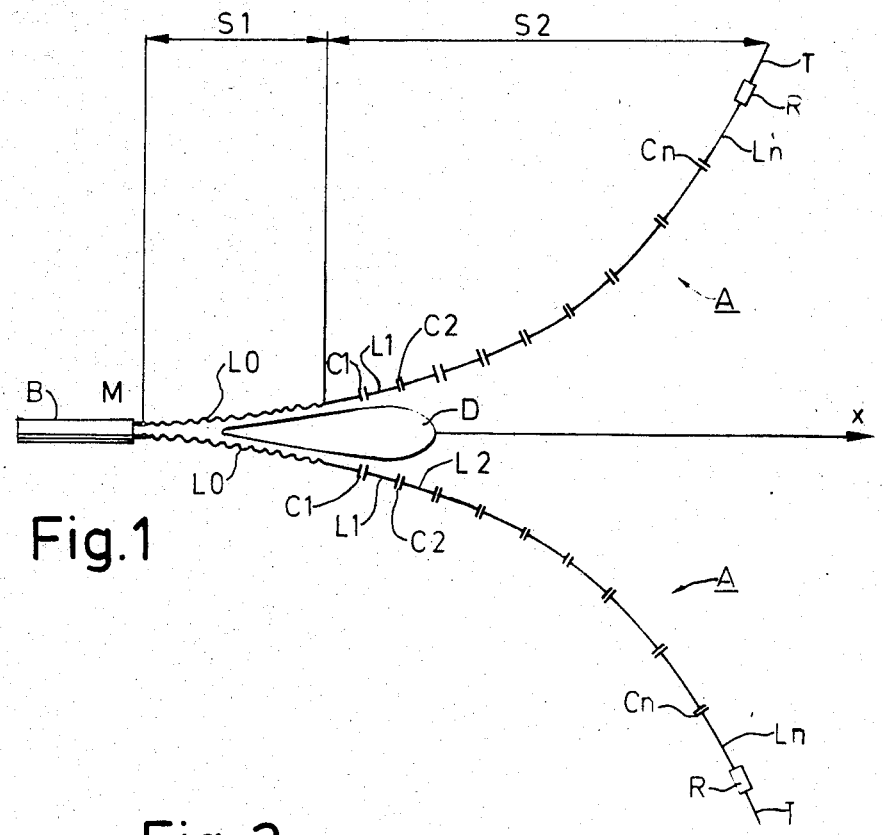
Fig.1
Fig. 2
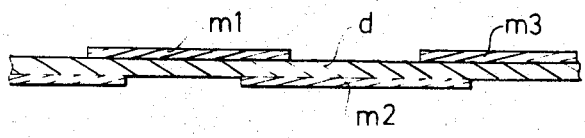
Fig.3
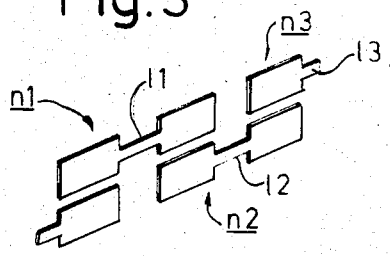
Fig. 4
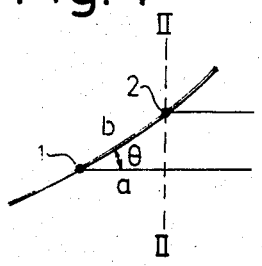

Y-SHAPED DIPOLE ANTENNA

BACKGROUND OF THE INVENTION

The invention relates to a directive broadband antenna element of V-shaped dipole type having bent wire or strip-shaped conductors forming dipole elements, a feed point being situated at the apex of the V and the radiation direction substantially coinciding with the line of symmetry through the apex of the V.

In particular it relates to a directive antenna element which can be used for example, as a broadband primary radiator for illuminating a parabolic reflector or an electromagnetic lens. It is desirable to place the primary radiator such that its center of radiation coincides with or is near to the focal point in the illuminated reflector or lens. This should be true across the whole frequency range of the primary radiator.

If the primary radiator is to be used in multilobe antennas, special requirements must be met, regardless of whether it is of the reflector or the lens type.

In a reflector antenna the reflected wave will pass the primary radiator, while for example in a circular lens antenna of Luneberg type with 360° bearing angle the primary radiator is passed by the waves transmitted from the opposite radiators.

The primary radiator disturbs the passing waves because its aperture has a blocking effect and because its mechanical structure has a certain shadowing effect. The blocking can be avoided by arranging the antenna element such that the polarization of the passing wave is orthogonal relative to that of the primary radiator. The shadowing effect can be reduced by making the structure of the primary radiator plane shaped and as small as possible. With such a shape for a directive antenna elements, it is difficult to obtain a large broadband performance and a good directive effect.

SUMMARY OF THE INVENTION

It is an object of the invention to provide a directive antenna element dimensioned such that it will have a small shadowing effect, and a bandwidth which can extend over a range of 2 to 3 octaves. The broadband performance is accompanied by a small displacement of the center of radiation (the phase center) with frequency, so that the element can be used as a primary radiator, in particular in multilobe antennas having focal points. The primary radiator should have a wide radiation lobe at low frequencies and a more narrow lobe for increasing frequencies, because the main lobe of the secondary lobe should be as constant as possible, i.e. frequency independent.

An antenna element in accordance with the invention is characterized in that the dipole conductors comprise a first section adjacent to the feed point, where radiation is minimized by spacing the conductors a small distance from and at a small inclination with respect to the line of symmetry. A following second section comprises series capacitances which are connected into the conductor for increasing the phase velocity. The values of the introduced series capacitances are individually chosen in such manner that they will give a reactance value per unit length of the antenna conductors which is so adapted to the actual position along the conductor and the prevailing inclination against the line of symmetry that the contributions from different parts of the conductor substantially cooperate in the radiation direction.

Because the dipole conductors in the vicinity of the feed point comprise a first section forming a transition portion from the incoming leader, where the conductors have a small distance to and a small inclination with respect to the line of symmetry, the radiation from this section is substantially reduced. Because the radiation to this section, in the degree it occurs, will take place at high frequencies the center of radiation for the high frequwncies is displaced outwardly along the line of symmetry. Thus the center of radiation for high frequencies is displaced closer to the center of radiation for low frequencies, which is situated closer to the open end of the V-shaped antenna element.

Preferably means are arranged at first section of the dipole conductors which reduces the phase velocity of the current wave travelling along the conductors. This will contribute to reducing the radiation in this section, so that the center of radiation for high frequencies is further displaced in the direction away from the feeding point.

After the first section follow sections where, as a result of the bending of the dipole conductors and the increasing distance between them, essential radiation, also at lower frequencies, will occur from each infinitesimal length of the conductors. Without special measures the radiation per unit length, however, would not be sufficient, and it would be necessary to make the antenna element long in order to achieve radiation effectieness. For a small antenna measured in number of wave lengths, only a part of the energy fed to the antenna would be able to radiate before it has reached the ends of the dipole conductor. The radiation is, however, substantially increased if in accordance with the invention capacitive series reactances are introduced into the dipole conductors. The control of the phase velocity and the radiation properties achieved by the introduction of the series capacitances is effective mainly within the low frequency part of the operating range of the antenna. However, it is within this part of the frequency range, where the dipole antenna structure is carrying current and where the displacement of the center of radiation mainly takes place. As a result of the series capacitances the needed length of the antenna element in the radiation direction can be substantially reduced. The series capacitances will also contribute to displace the center of radiation (the phase center) for low frequencies, in the direction of the feed point, i.e. toward the center of radiation for high frequencies.

For the upper part of the frequency band of the antenna, the radiation will mainly take place from an intermediate section immediately beyond the first section. For high frequencies, the antenna current along the more V-shaped part of the antenna conductors is most significant, as the current amplitude at the outer portions of the antenna conductors, for these high frequencies, has been attenuated by radiation from the inner portions.

The series capacitances are dimensioned in such manner that the radiation contributions from the individual infinitesimal lengths of the conductors cooperate in the desired radiation direction, which means that the individual contributions in this direction are in phase or substantially in phase. A calculation of the local capacitive reactances per unit length of the dipole conductors for fulfilling this condition determines the values for the local loading capacitances. Because the reactance per unit length is the primary consideration, small capacitances spaced at large distances or large capacitances placed closer together may be used as alternative equivalents.

It is to be observed that it is already known to load wire- or strip-shaped dipole antenna elements with reactances, for example series capacitances, distributed along the conductors. The purpose of the known constructions is, however, not to influence the center of radiation, but in one case to increase the aperture and in another case to attenuate the wave, so that reflections at the dipole ends are avoided. Any individual adaption of the values of the capacitances to the shape of a bent antenna element is not present in the known constructions.

The phase velocity reducing means at the first section of the dipole conductors can, in a preferred embodment include a small dielectric disc introduced into the gap between the dipole conductors, which disc acts as a dielectric rod antenna. The lobe at high frequencies will then be sharpened by "end-fire"-effect while the center of radiation for the high frequencies is also moved further forward in direction toward the center of radiation for the low frequencies.

The disc can suitably be V-shaped and fill the gap between the conductors. The disc can extend somewhat beyond the first section of the dipole conductors in the radiation direction, and possibly into a zone where the series capacitances are introduced.

The small dielectric disc contributes to the antenna current and thus the radiation in the high frequency part of the frequency range of the antenna substantially emanates from the more V-shaped part of the antenna element. Because the capacitive reactances decrease in the high frequency part of the frequency band of the antenna, the high frequency radiating V-shaped part of the antenna is positioned where the smallest increase of the phase velocity is required in order to ensure that the radiation contributions cooperate in the desired radiation direction. The reduced effect of the capacitive reactances is furthermore compensated by the introduction of the dielectric disc in such manner that the phase velocity in the zone between the antenna conductors is reduced, i.e. reduced increase of the phase velocity along the conductors due to reduced capacitive reactance is compensated by a decrease of the phase velocity in the space between the conductors and results in unchanged cooperation in the desired radiation direction between all current leading infinitesimal conductor sections.

Besides the dielectric disc, or alternatively to this disc, the phase velocity reducing means may comprise a zigzag-shaped or inwardly toothed form of the dipole conductors in the first section.

The conductor pieces between the series capacitances can be given lengths which correspond to half wavelengths for different frequencies within the operating frequency range of the antenna element. Thereby, increased radiation from certain parts of the antenna conductors for given parts of the frequency band will be obtained.

In order to attenuate any remaining wave before it has reached the ends of the dipole conductors, these conductors may preferably be provided with resistive sections near their outer ends.

In a suitable embodiment, the dipole conductors are made in printed circuit form and consist of conducting strips situated on opposite sides of a dielectric disc, the series capacitances being formed by overlapping portions of these conductive strips. If desired, the antenna conductors between the series capacitances may be shaped as waists, i.e. conductor sections with reduced sectional areas.

BRIEF DESCRIPTION OF THE DRAWING

An embodiment of the invention is illustrated in the accompanying drawing, in which:

FIG. 1 shows a schematic plan view of a directive antenna element according to the invention, FIG. 2 shows a sectional view through a section of a microstrip dipole conductor in an antenna element according to the invention, FIG. 3 shows a schematic perspective view of the conductor pattern in an embodiment of the antenna element according to FIG. 2, and FIG. 4 shows a schematic view of a section of a dipole conductor in an antenna element according to the invention in order to illustrate the calculation of series capacitances for a required increase in phase velocity.

DESCRIPTION OF THE PREFERRED EMBODIMENTS

In FIG. 1, A designates the two dipole conductors in an antenna element of the V-shaped dipole type according to the invention, B is a symmetric supply conductor which is coupled to the two dipole conductors at a feed point M and x is the axis of symmetry through the apex of the V, which coincides with the radiation direction.

The dipole antenna includes a first section S1 with a relatively large extension in the x-direction, where the dipole conductors L0 are situated close to the symmetry axis x and diverge slowly. The proximity of the conductors to each other and the small angle between the conductors causes the radiation of energy from this section to be very small. In order to further decrease the radiation of energy, the phase velocity of the current wave along this section may be further reduced by inductive loading. In FIG. 1 this is illustrated by a folded shape of the conductors L0. Furthermore there is a dielectric disc D in the gap between the conductors L0 in the section S1. In addition to reducing the phase velocity in the section S1, the dielectric disc D acts as a rod antenna, whereby the lobe at high frequencies will be sharpened due to "end-fire"-effect. The disc D may as shown extend a distance beyond S1 and into the following section S2 (see below).

After the section S1 with reduced phase velocity and reduced radiation there follows a section S2, where the antenna element can radiate energy due to the increasing distance between the dipole conductors. The dipole conductors here follow a path which is bent according to a selected function (for example a circular path) and are divided into a number of short conductor pieces L1, L2, L3, . . . Ln which are interconnected via series capacitances C1, C2, . . . Cn. Close to the outer ends of the dipole conductors are resistive loading impedances R, and the conductors are terminated by terminal conductor pieces T.

By loading the dipole conductors with capacitances, the phase velocity in section S2 will be increased. The smaller the capacitances are, i.e. the higher the capacitive reactance is, the more rapid the wave will be. However, it is not allowed to load the conductors too much as the reactive loading causes the outer wave guide formed by the conductors exhibit a decreasing conductance. Finally the conductance of the surrounding air 377 ohm/square will be higher than that of the conductor. The wave then leaves the conductor. The above-described antenna produces about a 3.5 times increase of the phase velocity, i.e. in a physical distance corresponding to a half wavelength the phase will not vary 180° but 180°/3.5=51.4°.

With knowledge of these restrictions the capacitive loading can be adapted to the selected shape of the dipole conductors so that different partial waves leaving the dipole elements at different places will have such phase positions that the radiation contributions will cooperate in a desired radiation direction, for example in the direction of the x axis, resulting in optimal radiation effectiveness. In other words the difference in travel distance for a partial wave which travels a longer distance along the dipole conductors as compared with a partial wave which travels a shorter distance along the conductor and then in air will be compensated by the increased phase velocity. The values of the different capacitances are individually chosen so that this condition is fulfilled. These values are primarily determined by the locally prevailing angle between the antenna conductor and the radiation direction x. Another parameter determining the value of each individual capacitance is the distance to the next capacitance. These distances, i.e. the length of the conductor pieces L1, L2, . . . Ln in FIG. 1, can be selected such that they correspond to approximately up to a half wavelength for different frequencies within the frequency range of the antenna. The resulting current distributions at the different conductor pieces L1, L2, . . . Ln for different frequencies within the frequency range of the antenna then brings about a somewhat increased radiation, resulting in that a smaller amount of power is lost in the loading resistance R.

FIG. 2 shows a suitable embodiment of antenna conductor with series capacitances. The whole antenna is in this case made in microstrip-form and consists of strip-shaped conductors m1, m2, m3, . . . arranged alternatingly on the one side and the other side of a thin dielectric disc d. The capacitances C1, C2, . . . are formed by the overlapping parts of the conductors arranged on opposite sides of the dielectric disc, while the conductor pieces L1, L2, . . . are formed by the central part of each strip, m1, m2, . . . which has no opposite conductor on the other side of the disc d.

FIG. 3 shows an embodiment of the conductor pattern in an antenna element which is generally constructed in microstrip-form according to FIG. 2. Each conductor strip n1, n2, n3, . . . has according to FIG. 3 a waist 11, 12, 13, . . . i.e. a section with reduced sectional area, at a middle part of the respective conductive strip. This contributes to an even more improved radiation and damping of the wave before it has reached the ends of the dipole conductors.

FIG. 4 shows an infinitesimal section of a bent antenna element for illustrating the increase of the phase velocity, which is required in order to bring the contributions from different infinitesimal parts of the element to come in phase with each other so that they cooperate in the desired radiation direction. In FIG. 4 two points 1 and 2 are considered, which are situated at a distance b from each other along a conductor and at the distance a from each other in the radiation direction x. The conductors form an angle $\theta$ with the radiation direction x. Now consider the plane II—II through the point 2, and the radiation contribution from the point 1 travelling the distance a, for example in free space at the velocity of light, to the plane. In order to ensure that the contribution from the point 2 shall be in phase with the contribution from the point 1 then it is required that the contribution travelling along the conductor to the point 2 has a phase velocity which is b/a times larger than the velocity of light. From FIG. 4 it is evicent that $b/a=1/\cos\theta$. Thus the phase velocity v in this section of the conductor shall fulfill the condition:

$$v/c_o=1/\cos\theta \tag{1}$$

where $c_o$ is the velocity of light.

This increased phase velocity v relative to the light velocity $c_o$ shall be produced by the introduced series capacitances. Beginning with the intrinic capacitance and inductance of the selected antenna conductors, i.e. their reactances before the introduction of the loading capacitances, it is possible to calculate the additional reactance per unit length of the antenna conductors required for fulfilling the condition (1). Then the following result is achieved:

$$\frac{1}{\omega C_s}=\frac{Z_o\cdot f_1(\omega)\cdot f_2(\theta)}{c_o} \tag{2}$$

where $1/\omega C_s$ is the introduced reactance in ohm per meter, $C_s$ is the introduced capacitance, $Z_o$ is the wave impedance of the unloaded antenna on the place where $C_s$ is to be introduced, $\omega$ is the angular frequency of the wave energy, and $f_1(\omega)$, $f_2(\theta)$ are two simple mathematical functions of $\omega$ and $\theta$, respectively.

The wave impedance $Z_o$ is dependent on the intrinsic inductance and capacitance per unit length of the unloaded antenna conductors, and also on the angle $\theta$, and can be calculated for each infinitesimal section of the conductor.

In determining the reactances, first the size and shape of the antenna conductors is determined with consideration given to the desired operating frequency range. The distance between the outer ends of the dipole conductors must be larger than a half wavelength at the lowest frequency. The active part of the antenna starts where the distance between the dipole conductors is of the magnitude of a half wavelength at the highest frequency. The shape of the conductors is determined under the condition that the extension of the antenna in the x-direction shall be as small as possible and the curvature is consequently made as sharp as possible without causing mismatching. When the shape of the conductors has been determined and the type of conductor has been selected the calculation of the additional capacitances $C_s$ can be made according to the equation (2). The calculation is suitably made at a frequency lying somewhat below the geometric mean frequency which is the geometric mean value F of the highest frequency $F_{max}$ and the lowest frequency $F_{min}$ $$F=\sqrt{F_{max}\cdot F_{min}}$$

The calculation results in a value of the magnitude of the loading capacitances or more exactly a reactance value per unit length of the conductor at the above frequency, which reactance value is different for different places of the conductor. There is one further parameter to determine, namely the distance between the introduced additional capacitances. A given capacitance value per unit length can be obtained by means of a large capacitance at a small distance to the next following capacitance or a smaller capacitance at a larger distance to the following capacitance. This can be utilized in such manner that sparsely placed capacitances are used in the outer parts of the antenna element and large, relatively closely situated capacitances are used in the parts of the antenna element which are closest to the feeding point.

The distances between the capacitances can be selected such that half wave resonance with a low Q-value will arise in the different conductor pieces for frequencies within the operating frequency range. The dimensioning may for example be made such that half wave resonance first arises in the partial element lying closest to the loading resistance, at a frequency which is high above the mean frequency, if the current wave has not been fully attenuated by radiation. This results from the fact that the reactances of the loading capacitances are reduced with increasing frequency. The last conductor piece but one is shorter and thus has resonance for a somewhat higher frequency etc. The increased radiation due to resonance causes a smaller amount of power to be lost in the loading resistance R.

The above-described antenna fulfills all the requirements mentioned in the opening paragraph for a directive broad-band antenna. It can be made in a thin plane, has small outer dimensions, produces a small shadowing effect for all combinations of polarization and striking angles except the desired one has a center radiation is substantially constant independently of the frequency, and has a wide radiation diagram at low frequencies and a smaller one for increasing frequencies.

A pair of antennas of the type described are suitable for stacking. Then the antenna planes are placed in parallel or substantially in parallel as in the case with the Luneburg lens, where all the primary radiation planes are directed toward the center of the lens. The planes are placed approximately a wavelength from each other at the highest frequency.

Within the scope of the invention the radiation direction may, if desired, deviate from the line of symmetry, and it is even possible that the conductors deviate somewhat from the symmetric form.

What is claimed is:

1. A directive antenna comprising a substantially V-shaped dipole including first and second curved conductors diverging from opposite sides of a line of symmetry extending from an apex of the dipole in a predetermined direction of radiation, said V-shaped dipole comprising:

(a) a feed point at the apex of the dipole;

(b) a first section extending from the apex, where the distance and the angle between the conductors are sufficiently small that radiation from said section is minimized and is primarily in an upper frequency range of the antenna; and (c) a second section extending from the first section, where each of said curved conductors comprises successive portions connecting in series a plurality of capacitive reactances at predetermined positions along the length of the respective conductor, the capacitive reactance at each position having a value which, for the angle between the line of symmetry and the respective conductor at said position, effects production of a respective predetermined phase velocity, said predetermined phase velocities increasing with distance from the apex of the dipole such that radiation from different positions is substantially in phase in the predetermined direction of radiation.

2. A directive antenna as in claim 1, where the first section of the dipole includes phase-velocity-reducing means for reducing the phase velocity and displacing the phase center, at the upper frequency range of the antenna, in a direction away from the feed point.

3. A directive antenna as in claim 2, where the phase-velocity-reducing means comprises a dielectric disc extending into a gap between the dipole conductors.

4. A directive antenna as in claim 3, where the dielectric disc is generally V-shaped and fills the gap between the conductors.

5. A directive antenna as in claim 3 or 4, where the dielectric disc extends into the second section of the dipole.

6. A directive antenna as in claim 1, 2, 3 or 4, where the phase-velocity-reducing means comprises nonlinear shaped portions of the conductors.

7. A directive antenna as in claim 1, 2, 3 or 4, where the successive portions of the conductors connecting in series the capacitive reactances have differing lengths, each length corresponding to a half wavelength of a respective frequency within the operating frequency range of the antenna.

8. A directive antenna as in claim 7 where the capacitance values of the successive capacitive reactances decrease with distance from the apex of the dipole, and where the lengths of the successive portions of the conductors increase with distance from said apex.

9. A directive antenna as in claim 1, 2, 3 or 4, where each of the conductors includes a resistive portion near an end thereof remote from the apex of the dipole.

10. A directive antenna as in claim 1, 2, 3 or 4, where the conductors comprise conductive strips disposed on opposite sides of a dielectric disc, the series capacitive reactances being formed by overlapping portions of the conductive strips situated on opposite sides of the dielectric disc.

11. A directive antenna as in claim 10 where the portions of the conductive strips disposed between the series capacitive reactances have reduced area sections.

* * * * *